US005376261A

United States Patent [19]

Avidan

[11] Patent Number: 5,376,261

[45] Date of Patent: Dec. 27, 1994

[54] PROCESS AND APPARATUS FOR NON-MECHANICAL FLOW CONTROL OF CATALYST AROUND A CATALYST REGENERATOR

[75] Inventor: Amos A. Avidan, Yardley, Pa.

[73] Assignee: Mobil Oil Corporation, Fairfax, Va.

[21] Appl. No.: 515,932

[22] Filed: Apr. 27, 1990

[51] Int. Cl.[5] ..... C10G 9/32

[52] U.S. Cl. ..... 208/157; 208/150; 208/161; 208/164

[58] Field of Search ..... 208/164, 161, 113, 120, 208/157, 150; 422/142

[56] References Cited

U.S. PATENT DOCUMENTS

| | | | |
|---|---|---|---|
| 2,589,124 | 3/1952 | Packie . | |
| 2,850,364 | 9/1958 | Dowling | 208/164 |
| 3,630,886 | 12/1971 | Deed et al. | 208/164 |
| 3,687,841 | 8/1972 | Saxton et al. | 208/164 |
| 3,923,642 | 12/1975 | Lukenbach et al. | 208/164 |
| 3,996,013 | 12/1976 | Lukenbach et al. | 208/164 |
| 4,006,075 | 2/1977 | Lukenbach et al. | 208/164 |
| 4,062,759 | 12/1977 | Castagnos, Jr. et al. | 208/164 |
| 4,146,463 | 3/1979 | Rudford et al. | 208/164 |
| 4,574,044 | 3/1986 | Krug | 208/164 |
| 4,605,491 | 8/1986 | Haddad et al. | 208/164 |
| 4,629,552 | 12/1986 | Haddad et al. | 208/164 |
| 4,875,993 | 10/1989 | Mauleon et al. | 208/164 |
| 4,921,596 | 5/1990 | Chou et al. | 208/164 |

OTHER PUBLICATIONS

Oil & Gas Journal FCC Report p. B33 Jan. 8, 1990.

*Primary Examiner*—Helane Myers

*Attorney, Agent, or Firm*—Alexander J. McKillop; Malcolm D. Keen; Richard D. Stone

[57] ABSTRACT

A process and apparatus for controlling the flow of FCC catalyst around a catalyst regenerator, using a non-mechanical valve, is disclosed. The preferred non-mechanical valve provides a de-aeration section, addition of fluidizing gas, a "U" trap seal, and venturi gas outlet on the top of the trap, for reliable flow control of non-uniform settling particles such as FCC catalyst. Control of the flow of a fluidizing gas to such a valve changes the flow properties of the FCC catalyst and permits flow control without resort to plug valves, or other internal mechanical valves, which are difficult to use in the harsh environment experienced within FCC regenerators.

2 Claims, 2 Drawing Sheets

PROCESS AND APPARATUS FOR NON-MECHANICAL FLOW CONTROL OF CATALYST AROUND A CATALYST REGENERATOR

BACKGROUND OF THE INVENTION

1. FIELD OF THE INVENTION

The field of the invention is control of the flow of fluidized solids.

2. DESCRIPTION OF RELATED ART

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425C.-600C., usually 460C.-560C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500C.-900C., usually 600C.-750C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan et al, as reported in the Jan. 8, 1990 edition of the Oil & Gas Journal.

Modern catalytic cracking units use active zeolite catalyst to crack the heavy hydrocarbon feed to lighter, more valuable products. Instead of dense bed cracking, with a hydrocarbon residence time of 20-60 seconds, much less contact time is needed. The desired conversion of feed can now be achieved in much less time, and more selectively, in a dilute phase, riser reactor.

Although reactor residence time has continued to decrease, the height of the reactors has not. Although the overall size and height of most of the hardware associated with the FCC unit has decreased in size, the use of all riser reactors has resulted in catalyst and cracked product being discharged from the riser reactor at a fairly high elevation. This elevation makes it easy for a designer to transport spent catalyst from the riser outlet, to a catalyst stripper at a lower elevation, to a regenerator at a still lower elevation. The great "head" afforded by modern designs does increase the head or pressure generated by dense bed fluidized catalyst streams. This usually does not cause too much of a problem when flow control means, such as slide valves, are used to manipulate and control catalyst flows, but can lead to severe problems when an internal valve, such as a ceramic plug valve, is used.

Internal plug valves are used, and indeed essential, for use in modern, compact FCC designs such as the Kellogg Ultra Orthoflow converter, Model F, which is shown in FIG. 1 of this patent application, and also shown as FIG. 17 of the Jan. 8, 1990 Oil & Gas Journal article discussed above. Such a design is compact, efficient, and has a very small "footprint". Because of the compact nature of the design, and the use of a catalyst stripped which is contiguous with and supported by the catalyst regenerator, it is necessary to use an internal means to control spent catalyst flow from the catalyst stripper to the catalyst regenerator, such as a plug valve. Plug valves work, but they are expensive, and subject to a number of problems, as will be evident from the following review of the problems associated with plug valves which was abstracted from U.S. Pat. No. 4,827,967 May 9, 1989 Junier, which is incorporated herein by reference.

Flow control of catalyst from the standpipe into the dense phase of the regenerator from the stripper, and from the regenerator into the riser reactor, is obtained by the use of plug valves engageable with the lower ends of the transfer lines and having elongated valve stems extending through the vessel wall controlled in their longitudinal movement by external mechanical or manual operating means. These plug valves are used in oil refineries in controlling the flow of catalyst into a reaction chamber which is subject to temperature extremes, for example, in the range of 1500° F., as well as in other industrial applications wherein the valves are subject to oppositely directed displacements due to thermal expansion and spring forces.

Plug valves (such as Kellogg Orthoflow Valve, U.S. Pat. No. 2,850,364) are used to control the flow of catalyst to introduce a lift medium such as oil feed stock or lift air into a riser line. One problem occurring with the hollow tube plug valve providing a lift medium through the center hollow section is that the lift medium pressure at the inlet of the valve cannot be maintained at a high enough level to overcome the bottom regenerator pressure. If the regenerator pressure is greater than the lift air pressure, catalyst from the regenerator can block the valve's guide liners and cause the valve to stick. Another problem with prior art valves occurs when the pressure of the lift medium is greater than the regenerator pressure, permitting the lift medium to go between the valve's guide liners causing the valve to stick.

There has been a long-felt need to overcome the problems associated with the prior art plug valves. The present invention addresses and satisfies this long-felt need by eliminating the plug valve, and replacing it with a non-mechanical catalyst flow control means.

Although the most severe problems with plug valves are encountered with those operating inside bubbling dense bed regenerators, there are other places where plug valves are used in FCC units that are also troublesome, such as to control the flow of regenerated catalyst to the riser reactor.

Use of slide valves is common in FCC units when the catalyst stream to be controlled is flowing through a pipe. Slide valves have different problems than plug valves, but are not trouble free. A severe problem is erosion of the slide. Some FCC units end their refinery runs with slide valves in the closed position, which operate as if they were wide open.

The present invention is directed to a novel and efficient way of overcoming the deficiencies of existing technology for controlling the flow of catalyst from a catalyst stripper down through a standpipe to a catalyst regenerator directly underneath the stripper.

The present invention provides a way to control catalyst flow, without the complications and problems that are inherent in using an internal plug valve, namely sealing the plug valve despite the problems of: differentials in regenerator pressure and lift medium pressure; the unwanted sticking of the valves; and the need for excessive amounts of a purge medium.

The present invention provides a better way of controlling catalyst flows around an FCC regenerator, and provides ways of dealing with some of the special problems presented by typical FCC catalyst, namely the unusual settling and flow characteristics of FCC catalyst which make some of the conventional ways of controlling the flow of fluidized solids unsuitable for use in an FCC unit.

BRIEF SUMMARY OF THE INVENTION

Accordingly, the present invention provides a process for the fluidized catalytic cracking of a heavy feed to lighter more valuable products by mixing, in the base of a riser reactor, a heavy crackable feed with a source of hot regenerated zeolite containing catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone in a catalyst stripper contiguous with and beneath said disengaging zone and wherein said spent catalyst is contacted with a stripping gas to produce stripped catalyst, and wherein said stripped catalyst is collected in a vertical standpipe beneath the stripping zone, and stripped catalyst is discharged from said standpipe into a catalyst regeneration zone contiguous with and beneath said stripping zone, and wherein a mechanical plug valve is used to control flow of stripped catalyst from the stripper standpipe into the catalyst regenerator, characterized by use of a non-mechanical flow control means to seal the stripper standpipe and control the flow of stripped catalyst into the regenerator.

In another embodiment, the present invention provides a method of controlling the flow of fluidized solids which, when fluidized in a fluidized bed by the action of a fluidizing gas exhibit non-uniform settling when flow of fluidizing gas is reduced or eliminated, by passing said fluidized solids through a non-mechanical valve and therein charging a fluidized mass of said solids through a horizontal section having an equivalent diameter, de-aerating said fluidized mass by causing at least a portion of said fluidized solids to flow up into the inlet of an inverted "U" trap seal having a lower inlet, an upper region above said inlet, and an outlet at an elevation below said upper region; and controlling the flow of solids through said non-mechanical valve by adding a fluidizing gas downstream of said de-aeration and upstream of said upper region of said. "U" trap.

In an apparatus embodiment, the present invention provides an apparatus for controlling the flow of fluidized solids which, when fluidized in a fluidized bed by the action of a fluidizing gas exhibit non-uniform settling when flow of fluidizing gas is reduced or eliminated, comprising a vertical inlet adapted to receive a fluidized mass of solids and transfer said solids into a horizontal section, having an equivalent diameter and having an outlet; a de-aeration means adapted to de-aerate said fluidized mass and comprising solids an inverted "U" trap seal having a lower inlet connective with said horizontal section, an upper sealing region above said lower inlet, and an outlet at an elevation below said upper region; and a fluidizing gas inlet means connective with said lower inlet of said inverted "U" trap seal; and a gas outlet means having an equivalent diameter no more than 20% of the equivalent diameter of said horizontal section located in said upper region of said inverted "U" trap seal.

DESCRIPTION OF PREFERRED EMBODIMENTS

Figure 1:
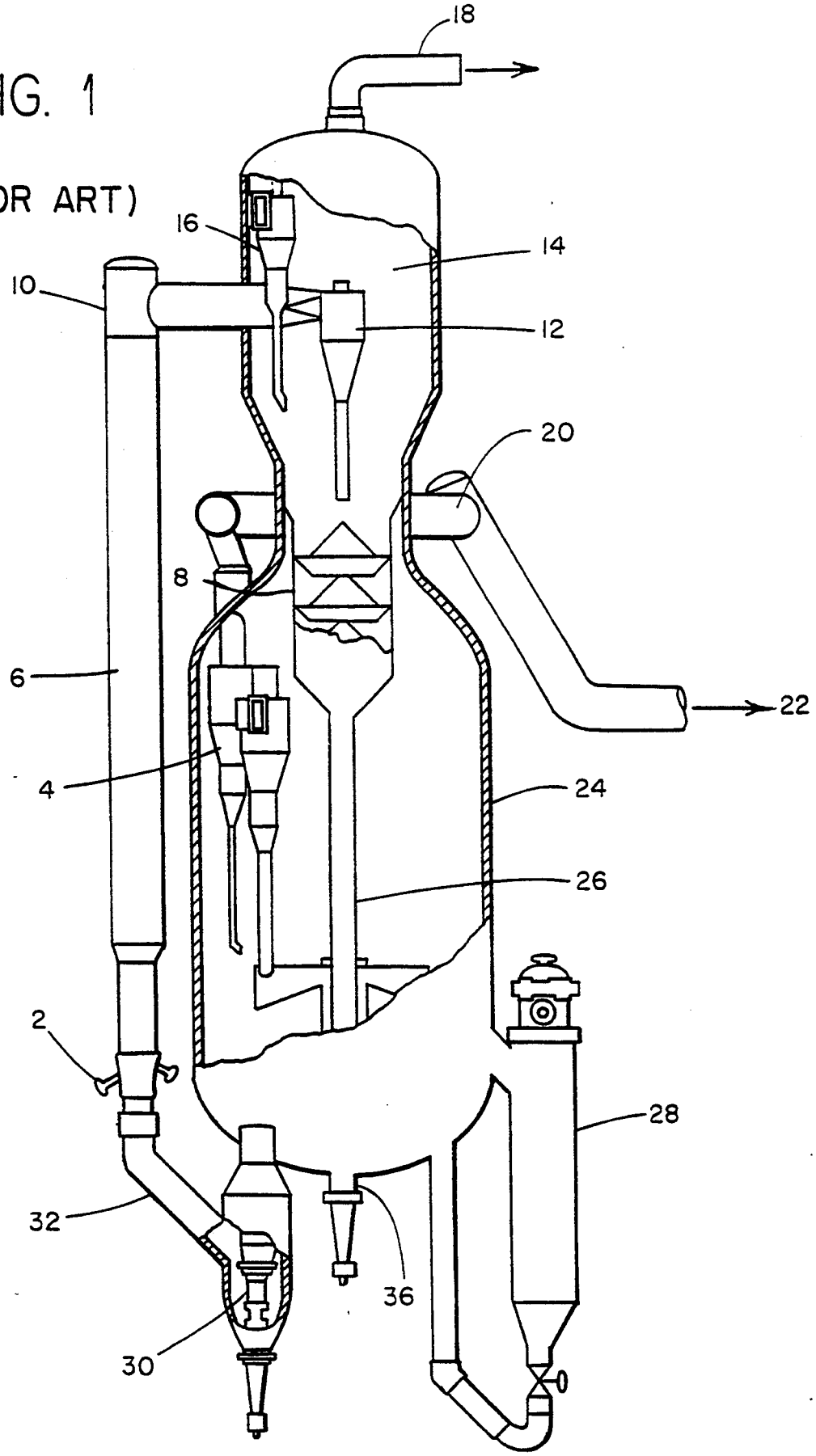
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated flue gas in multiple stages of cyclones 4, and discharged via outlets 8 into plenum 20 for discharge to the flare via line 22.

Figure 2:
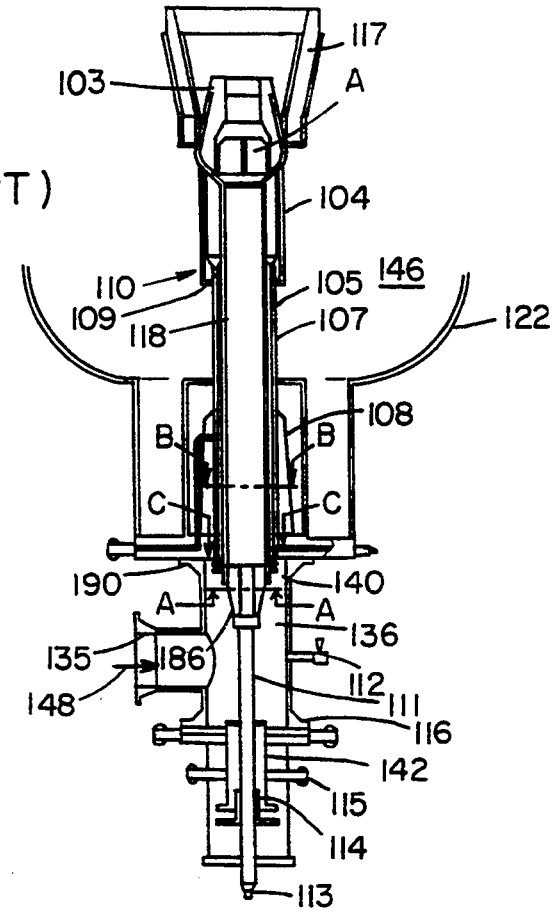
FIG. 2 (PRIOR ART)
FIG. 2 (prior art) is a side view in cross-section of a prior art plug valve.

Referring now to FIG. 2, a prior art plug valve 102 has a guide tube 107 within which is movably disposed a hollow stem tube 105. A plug closure member 103 is secured to one end of the stem tube 105. A channel 118 extends through the stem tube 105 and the plug closure member 103. An actuator (not shown) is connected to an end 113 of the stem tube 105. The actuator can move the stem tube 105 up and down within the guide tube 107 so that the plug closure member 103 is movable to affect the size of an opening 134 in a conduit 117 or so that the plug closure member 103 is seated on a seat 106 of the conduit 117 to prevent flow through the conduit 117.

Guide liner bearings 109 facilitate the movement of the stem tube 105 in the guide tube 107. A shroud 104 secured to the plug closure member 103 protects the stem tube 105 from wear due to catalyst flow.

A purge system 108 is provided which is in communication with the space between the guide tube 107 and the stem tube 105 for purging any unwanted fluid or material which moves into the space. A fluid (such as air) is flowed through the inlet 135 connected to the chamber 136 which is in communication with the channel 118. A fluid pumping source (not shown) pumps the fluid to the inlet 135 at a desired pressure. A pressure indicator 112 is connected to the chamber 136 for providing pressure reading for the fluid in the chamber 136. The end 113 of the stem tube 105 is connected to the shaft 111 which is in turn connected to the stem tube 105. The arrows in FIG. 2 show the path of air flow through the channel 118 and out of the plug closure member 103.

A lower stem purge system 116 provides purging for bearings 142 which encompass the shaft 111. A packing 114 is provided for the shaft 111 and a sealant injection device 115 provides the passage to inject a sealing medium for the purpose of renewing the packing while the plug valve is in service. A regenerator 122 is disposed about the plug valve and serves to contain fluidized catalyst. The plug valve controls the level of catalyst in the regenerator. From the regenerator the fluidized catalyst goes to an upper vessel (not shown) through the conduit 117.

As shown in FIG. 2, the plug closure member 103 is not seated in the seat 106 of the conduit 117. Fluid flow, such as a flow of catalyst particles, is permitted through the opening 134 of the conduit 117. The force of the air coming up through the channel 118 impels the catalyst particles into the conduit 117. When it is desired to cut off the flow of fluid through the opening 134, the activator (not shown) is activated to move the shaft 111, stem tube 105, and plug closure member 103 upwardly so that the plug closure member 103 seats against the seat 106 of the conduit 117.

Figure 3:
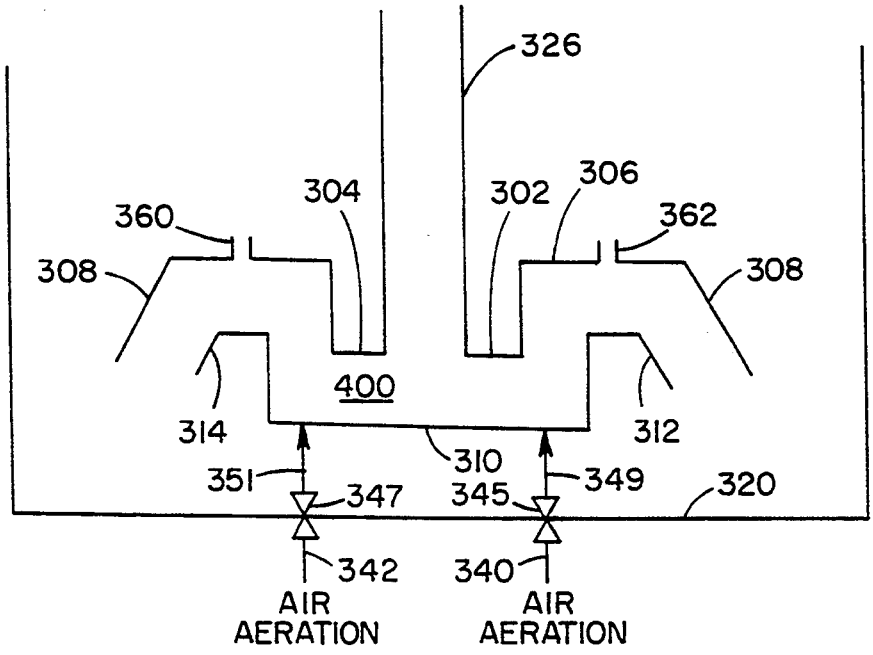
FIG. 3 is a schematic view of a preferred non-mechanical valve of the present invention.

FIG. 3 (Invention) is a simplified, schematic view of one embodiment of the invention, showing use of non-mechanical valve to replace the conventional plug valve in the base of the spent catalyst standpipe.

Spent catalyst, discharged from the catalyst stripper (not shown) is passed down the standpipe 326, which corresponds to standpipe 26 in FIG. 1, into non-mechanical valve means 310. Spent catalyst passes from the standpipe into a controllably aeratable or fluidizable volume 400 defined by annular spacer 302, outer shell 312, inner shell 304, top member 306 and a discharge means defined by upper opening 308 and a lower opening 314.

A fluidizing gas, preferably air, although any fluid could be used, is admitted via one or more openings such as air lines 340 and 342 connective with valve means 347 and 349 to control the flow of aeration gas via lines 349 and 351 into region 400.

A preferred, but optional, de-aeration nozzle is shown in the high spots of the non-mechanical valve. Venturi nozzle 360, or a simple length of tubing 362, may be used to help remove air or gas which collects in the high, unvented regions of the non-mechanical valve. These de-aeration nozzles have a function which is related in some ways to the vent pipes placed by the ancients in the low spots of siphons which crossed small valleys, namely that air would collect in unvented regions of the siphon and interfere with the smooth flow of fluid.

The action of the non-mechanical valve can best be understood by considering its two extremes, open and shut. The valve is "open" when enough fluidizing medium is admitted to agitate and fluidize region 400. Depending on the cross sectional area available for dense bed flow from the non-mechanical flow means 310, the valve can be open when some bed expansion is achieved, or when a bubbling fluidized bed is achieved, or even when some more vigorous flow regimes is achieved. Addition of fluidizing gas makes the catalyst behave more like a liquid, a very viscous liquid when relatively little fluidizing gas is added, and a very thin liquid when large amounts of fluidizing gas are added.

The non-mechanical valve is closed when little or no fluidizing gas is admitted, or when the amount admitted is not sufficient to expand or agitate the bed within region 400 sufficiently to permit much fluid flow.

DESCRIPTION OF PREFERRED EMBODIMENTS

FCC FEED

Any conventional FCC feed can be used. The process of the present invention is especially useful for processing difficult charge stocks, those with high levels of CCR material, exceeding 0.5 and up to 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

The most uplift in value of the feed will occur when at least 10 wt %, or 50 wt % or even more of the feed has a boiling point above about 1000° F., or is considered non-distillable.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–50 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such Katalistiks International, Inc.'s "DeSox."

CO combustion additives are available from most FCC catalyst vendors.

The FCC catalyst composition, per se, forms no part of the present invention.

CRACKING REACTOR/REGENERATOR

The FCC reactor, stripper and regenerator, per se, are conventional, and are available from the M. W. Kellogg Company.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900° to about 1100° F.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

NON-MECHANICAL VALVES

Although the non-mechanical valve illustrated in FIG. 3 is a preferred non-mechanical valve, there are equivalent means which may be used, but not necessarily with equal results. This can be better understood by first reviewing some of the special problems presented by FCC catalyst, and discussing why the FIG. 3 embodiment works well.

The embodiment shown in FIG. 3 is especially useful for controlling the flow of FCC solids, which do not behave like many fine solids. FCC catalyst, if placed in a conventional "L" valve, does not respond linearly to air flow. FCC catalyst behaves more like Geldart's Group A solids, and flow of FCC catalyst can only poorly be controlled in an L valve. Part of the problem with FCC catalyst is its unusual settling properties. FCC catalyst does not settle or defluidize right away. This can easily be seen in laboratory tests, with fluidization of small amounts of FCC catalyst in a container, followed by termination of air addition, and monitoring of the height of the fluidized bed. If plotted against time, the slope of the line for coarse particles, is equal to the minimum bubbling velocity, Umb. FCC catalyst does not behave this way however. For fine, Group A Geldart particles, Umb>Umb, so they do not defluidize well, nor lend themselves to flow control in a simple "L" valve. I realized that FCC catalyst requires additional residence time, and preferably at least one change in fluid flow direction to aid defluidization. Time and stirring, by causing the catalyst to flow up after entering the non-mechanical valve, aided de-aeration enough to permit reliable flow control of FCC solids.

The following may be used, in increasing order of preference.

The stripper standpipe may be immersed in the fluidized bed, with a "Dollar" plate at the base of the standpipe sized to restrict flow sufficiently to ensure a good seal on the standpipe. Such a design requires very close theoretical and experimental work before it could safely be used to seal the stripper standpipe. Such a design would not be very tolerant of upsets, changes in catalyst flow, and erosion, all of which are ever present in FCC units.

The stripper standpipe may be immersed in the fluidized bed, with a flapper valve. Preferably the standpipe is deeply immersed in the fast fluidized bed region as well. A flapper valve is a mechanical device, but solely for restricting reverse flow, so in that sense a flapper valve is non-mechanical valve for control of flow into the fluidized bed region. Flow into the fluidized bed region will be controlled by the relative pressures in the stripper and the regenerator, the height and density of catalyst in the standpipe, and the geometry of the standpipe.

An "ICI" valve may be used to control catalyst flow from the standpipe. Such a valve is disclosed in British Patent 607,723, which is incorporated herein by reference. This type of valve serves better as a seal device than as a flow control valve, although a significant measure of flow control can be achieved.

A standpipe may discharge into a "T". Relying on the angle of repose of FCC powder, typically around 30–35 degrees, to seal is not a very stable seal, however.

A preferred design, which is very close to that shown in FIG. 3, is the fluid seal pot. This device can look like a standpipe making a "U-turn". The stripper standpipe feeds the inlet of the "U", while the outlet of the "U" discharges into the fluidized bed region surrounding the valve. Fluidizing gas is added to at least the base of the "U" outlet, and preferably to both the inlet and the outlet.

The most preferred design is shown in FIG. 3. In its simplest form, this valve may be considered as a right angle turn, followed by a "U" seal, or equivalent. Preferably the standpipe turns 90° and extends horizontally either upstream of or in the "U" for a distance of 2 or 3 pipe diameters, and at least long enough so that the angle of repose of settled FCC catalyst will not allow draining of the standpipe if no fluidizing gas is added. Fluidizing gas is preferably added within 1 or 2 pipe diameters of the "U" seal, preferably in the form of a jet or stream of gas directed up into the U, or into the direction of fluid flow sought.

A review of suitable non-mechanical valves is contained in Perry's Chemical Engineering Handbook, 6th Edition, on pages 20–68 and 20–69, which are incorporated herein by reference. FIG. 20–85, on page 20–67 shows both the cone valve of the prior art, and an L Valve.

It should be emphasized that although non-mechanical valves are well known and widely used devices for controlling flow of fluidized solids such as FCC catalyst, such devices have been used to seal, e.g., cyclones wholly within a regenerator. Non-mechanical valves have never been used to control flow of catalyst from a catalyst stripper standpipe down into a regenerator directly beneath the stripper. Refiners have heretofore insisted on a mechanical valve to isolate the stripper from the regenerator, because the former contains hot hydrocarbons and the latter contains high temperature air. I realized that it was possible to use a properly designed non-mechanical valve in this service, and thereby eliminate the expensive and troublesome mechanical valves currently used for this service.

When used to control flow of catalyst into a bubbling bed regenerator, regardless of the non-mechanical valve chosen, it is beneficial if the valve outlet is immersed in the dense bed region of the regenerator. Although the back pressure will be somewhat higher in the lower depths of the dense bed, the density of the fluidized material, and its apparent viscosity, will also be greater, which minimize the chance of backflow of regeneration gas up into the stripper standpipe. Backflows are bad, but it is much better to have relatively dense partially regenerated catalyst backflow up the stripper standpipe than to have oxygen rich regeneration gas backflow.

I claim:

1. In a process for the fluidized catalytic cracking of a heavy feed to lighter more valuable products by mixing, in the base of a riser reactor, a heavy crackable feed with a source of hot regenerated zeolite containing catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone in a catalyst stripper contiguous with and beneath said disengaging zone and wherein said spent catalyst is contacted with a stripping gas to produce stripped catalyst, and wherein said stripped catalyst is collected in a vertical standpipe beneath the stripping zone, and stripped catalyst is discharged from said standpipe into a catalyst regeneration zone contiguous with and beneath said stripping zone, and wherein a mechanical plug valve is used to control flow of stripped catalyst from the stripper standpipe into the catalyst regenerator, the improvement comprising use of a non-mechanical flow control means having a vertical inlet for stripped catalyst discharged from said stripper standpipe connective with a horizontal section having a diameter and connected with an inverted "U" trap section, an inlet for fluidizing gas within said horizontal section at a distance no greater than twice the diameter of the horizontal section to seal the stripper standpipe and control the flow of stripped catalyst into the regenerator.

2. The process of claim 1 wherein the inverted "U" trap section comprises at least one outlet having an equivalent diameter no greater than 20% of the diameter of said horizontal section.

* * * * *